United States Patent [19]

Bouchard

[11] 3,947,035

[45] Mar. 30, 1976

[54] POOL DISC GAME

[75] Inventor: Andre Bouchard, Montreal, Canada

[73] Assignee: Lawrence Peska Associates, Inc., New York, N.Y. ; a part interest

[22] Filed: Nov. 11, 1974

[21] Appl. No.: 522,421

[52] U.S. Cl. ..... 273/126 R; 273/12

[51] Int. Cl.[2] ..... A63F 3/00

[58] Field of Search ..... 273/126 R, 3 B, 12

[56] References Cited

UNITED STATES PATENTS

| | | | |
|---|---|---|---|
| 623,597 | 4/1999 | Erickson | 273/126 R |
| 2,585,458 | 2/1952 | Gordon | 273/126 R |
| 2,640,697 | 6/1953 | Elersich | 273/12 |
| 3,547,443 | 12/1970 | Lacson | 273/126 |
| 3,653,665 | 4/1972 | Wahlberg | 273/126 R |

FOREIGN PATENTS OR APPLICATIONS

| | | | |
|---|---|---|---|
| 582,320 | 11/1946 | United Kingdom | 273/126 R |
| 583,689 | 12/1946 | United Kingdom | 273/126 R |
| 240,946 | 1/1960 | Australia | 273/126 R |

*Primary Examiner*—Richard C. Pinkham
*Assistant Examiner*—T. Brown
*Attorney, Agent, or Firm*—Richard E. Nanfeldt

[57] ABSTRACT

A pool disc game including thereof a rectangular shaped horizontally placed playing board having: peripheral siderails, four corner pockets, two sidewall pockets, and a slippery top surface. Fifteen disc of varying colors are inscribed with indicia ranging from one to 15. A white disc is propelled across the slippery playing surface, wherein the white disc strikes the various colored disc knocking the colored disc into the corner and sidewall pockets.

1 Claim, 4 Drawing Figures

POOL DISC GAME

SUMMARY OF THE INVENTION

My invention relates to a unique and novel pool game, wherein a plurality of cylinder shaped disc are used in place of the conventional pool balls.

It is known from U.S. Pat. Nos. 2,824,739; 3,042,407; and 3,088,740 that disc games have been employed but these games involve paddles or cue sticks for propelling the disc across the playing surface.

Accordingly, it is an object of my invention to provide a game of pool, wherein a plurality of cylinder shaped disc are substituted for the conventional pool balls.

A further object of my present invention is to provide a non cue stick means of propelling a white disc across the playing surface, wherein the white disc strikes directly or by an angular bank shot the plurality of colored cylinder disc.

A still further object of my present invention is to provide a slippery top surface to a horizontally playing board.

An advantage of my present invention is that it provides a game of entertainment involving the development of hand and arm muscles.

Briefly, my present invention comprises a rectangular shaped horizontally placed playing board having peripheral siderails, four corner pockets, two sidewall pockets, and a slippery top planar surface. Fifteen disc of varying colors are inscribed with indicia ranging from one to 15. A white disc is propelled across the slippery playing surface, wherein the white disc strikes the various colored disc by either a direct strike or an angular bank shot off of the siderails of the playing board. The colored disc are propelled into the corner and sidewall pockets of the playing board.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
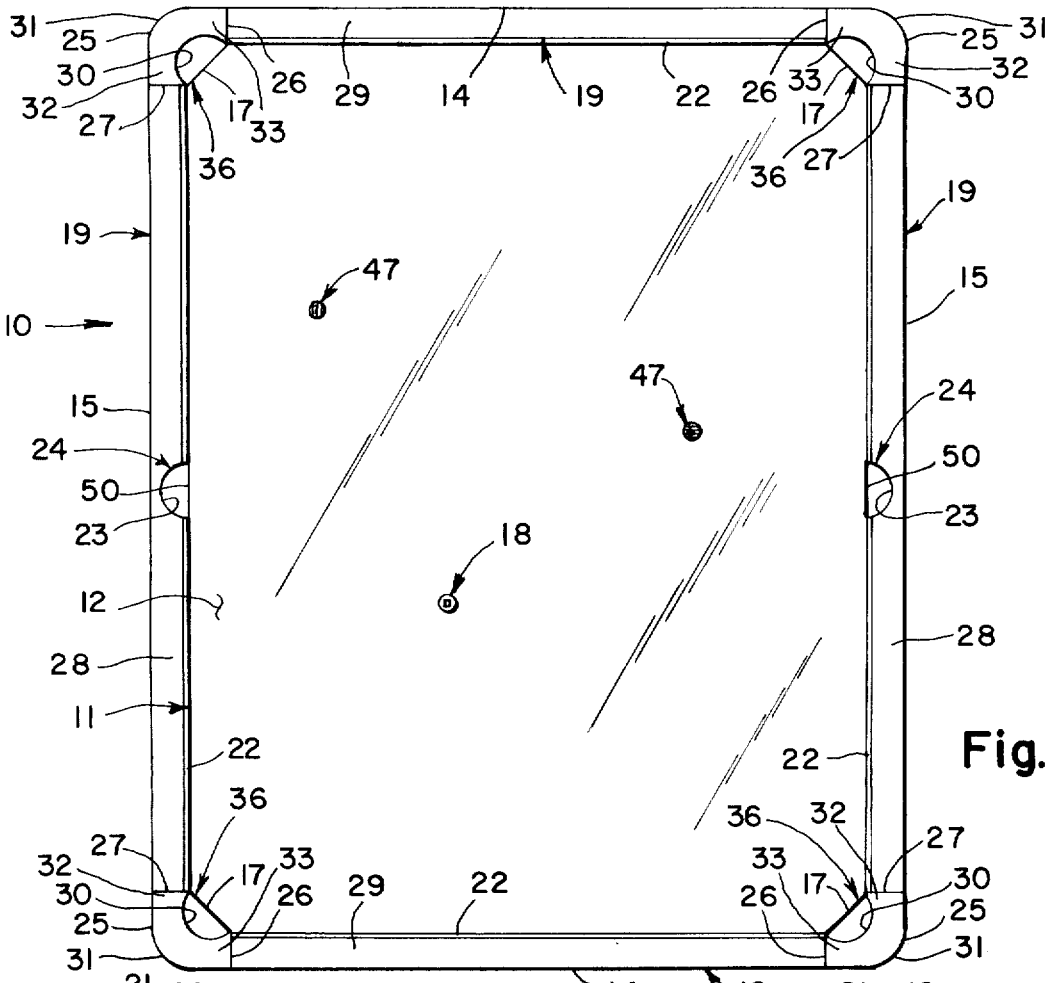
FIG. 1 illustrates a top view of the playing board.
Figure 2:
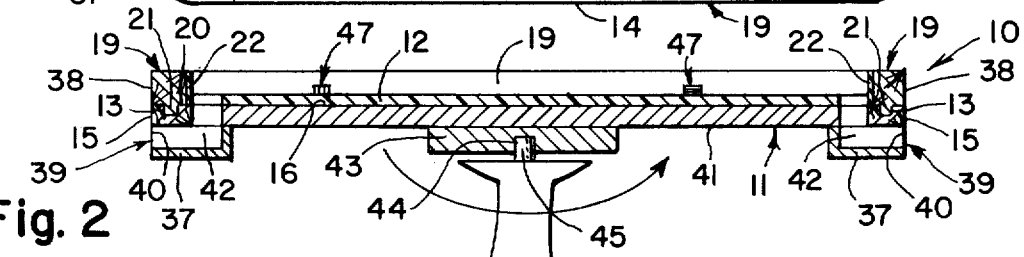
FIG. 2 illustrates an end elevated view of the playing board.
Figure 3:
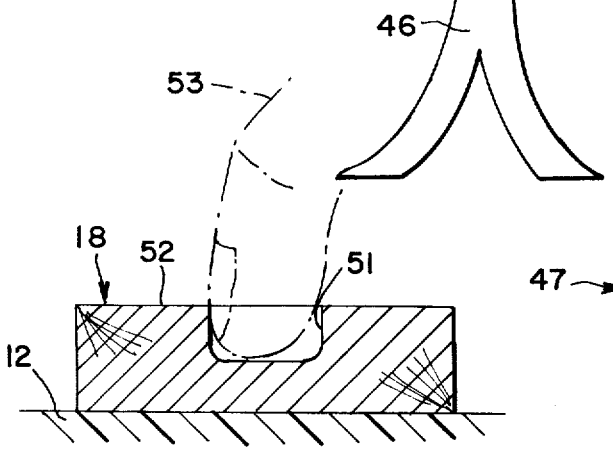
FIG. 3 illustrates a side cross section view of the white cylinder shaped disc.
Figure 4:
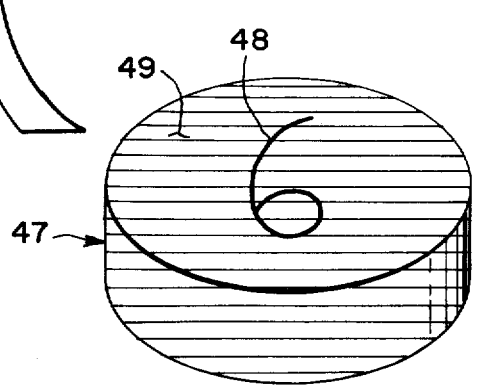
FIG. 4 illustrates a top perspective view of the colored disc.

Turning now descriptively to the drawings, in which similar reference characters denote similar elements throughout the several views, FIGS. 1–2 show a pool disc game comprising a game board 10 constructed of a rectangular shaped playing board 11 having a slippery top surface 12 of a low coefficient of friction. A rectilinear channel 13 is contained along each lateral end 14 and longitudinal side 15 of the board 11, wherein the channel 13 is contained in the top surface 16 of the board 11. The four corners 17 of the board 11 are cutaway on a bias. A half circle aperture 50 is contained midway on each longitudinal side 15 of the board 11. The side rails 19 of the playing board 11 comprise rectangular block member 19 having on their bottom surfaces 20 a center longitudinally placed tongue 21. The tongue 21 are adhesively affixed into the channels 13, wherein the rectangular block members 19 extend vertically upward from the horizontally placed board 11. A rubber bumper 22 is contained on the inside vertical face of the side rails 19. A laterally placed half circle aperture 23 is contained midway on each longitudinal placed side rail 28, wherein aperture 50, 23 align with each other to form the sidewall pockets 24 of the playing board 11. At each corner of the playing board 11, a molded right corner piece 25 is affixed to an end 26 of a lateral side rail 29 and an end 27 of a longitudinal siderail 28. A second laterally placed half circle aperture 30 is recessed into the inside juncture 31 of the legs 32, 33 of each molded corner piece 35, wherein aperture 30 aligns with each cut away corner 17 of the playing board 11 to form the corner pockets 36 of the playing board 11. A vertically placed flange member 37 is affixed to the outside vertical sidewall 38 of each longitudinal side rail 28, wherein flange 37 extends downward below the horizontal plane of the playing board 11. A disc retrival assembly 39 comprises an L shaped member 39 affixed between an inside vertical sidewall 40 of flange 37 as well as the inside vertical sidewall of the molded corner piece 25 and the bottom base 41 of the playing board 11 forming a hollow rectilinear chamber 42 communicating with the pockets 24, 36. A mounting plate 43 having a centrally placed vertical bore 44 is mounted at each lateral side 14 to the bottom base 41 of the playing board 11. A vertically placed rod 45 mounted on top of a pedestal leg assembly 46 is rotatably mounted within a vertical bore 44, wherein the pedestal leg assembly 46 can be rotated through a 360° arc relative to the playing board 11. The playing disc 47 comprises a cylinder shaped element 47 having a given indicia 48 ranging from one to 15 inscribed on a top lateral surface 49 of the cylinder shaped element 47. Each disc 47 numbered from one to 15 being of a different color. The sixteenth disc 18 is white having a finger tip recess 51 in its top lateral base 52. A player inserts his index finger 53 into recess 51 of white disc 18 and flicks or pushes the white disc 50 across the slippery surface 12 of the playing board 11 engaging the colored disc 47 by either a direct hit or an angular back shot off of the rubber bumpers 22. The objective of the game being to propel the colored disc 47 into the pocket 24, 36 of the game board 10. The rules of the various games played on the game board 10 correspond to the rules of conventional pool, snookers or billiards.

Hence obvious changes may be made in the specific embodiment of the invention described herein, such modification being within the spirit and scope of the invention claimed, it is indicated that all matter contained herein is intended as an illustrative and not as limiting in scope.

Having thus described the invention, what I claim as new and desire to secure by Letters Patent of the United States is:

1. A pool disc game which comprises:

a. a rectangularly shaped playing board having a top slippery surface, a rectilinear channel contained in said top surface along two lateral ends of two longitudinal sides of said board, four bias cutaway corners, and a half circle aperture midway on each said longitudinal side of said board;

b. side rails extending upwardly from said top surface, each said side rail formed from a block member having a tongue extending downwardly from a bottom surface of said block member, each said tongue affixed into said rectilinear channel, said two side rails along said longitudinal sides of said board having a laterally placed half circle aperture therein;

c. rubber bumpers affixed onto vertical inside walls of said side rails;

d. molded corner pieces joining ends of four said side rails together, each said molded corner piece having a laterally placed half circle aperture recessed therein, said aperture of said molded piece aligned with said cutaway corner;

e. vertically aligned flange members affixed to outside sidewalls of said side rails, said flanges extending downwardly below said board;

f. L-shaped members, each said L-shaped members affixed between each said flange and a bottom surface of said board forming a rectilinear chamber therein;

g. a mounting plate having a centrally placed vertical bore therein, said plate affixed to said bottom surface of said board;

h. a pedestal leg assembly;

i. a vertically placed rod affixed to a top of said leg assembly, said vertical rod rotatably contained in said bore of said plate;

j. fifteen colored cylindrically shaped disc having indicia ranging from one to 15 inscribed on a top lateral surface of said cylindrically shaped disc, said discs slidably contained on said top surface of said board; and k. a white cylindrically shaped disc having a top lateral base with a finger tip recess therein, said recess adapted to receive a finger tip therein, said white disc slidably contained on said top surface of said board, said white disc striking and propelling said 15 colored disc across top surface of said board.

* * * * *